United States Patent [19]

Edwards

[11] Patent Number: 4,574,678

[45] Date of Patent: Mar. 11, 1986

[54] STRING LOCKING ASSEMBLY FOR A MUSICAL INSTRUMENT

[76] Inventor: William H. Edwards, 8890 56th St., Temple Terrace, Fla. 33617

[21] Appl. No.: 626,444

[22] Filed: Jun. 29, 1984

[51] Int. Cl.[4] ..... G10D 3/12

[52] U.S. Cl. ..... 84/314 N; 84/297 R; 24/134 R

[58] Field of Search ..... 24/132 R, 132 WL, 134 R, 24/134 KA, 134 KB, 524, 568; 84/214, 314 N, 313

[56] References Cited

U.S. PATENT DOCUMENTS

| | | | |
|---|---|---|---|
| 118,353 | 8/1871 | Faas | 84/214 |
| 550,268 | 11/1895 | Hafer et al. | 84/214 |
| 1,331,203 | 2/1920 | Knapp | 24/134 R |
| 3,093,220 | 6/1963 | Modrey . | |
| 4,149,443 | 4/1979 | Bringe | 84/318 |
| 4,171,661 | 10/1979 | Rose | 84/313 |
| 4,248,127 | 2/1981 | Lieber . | |
| 4,457,201 | 7/1984 | Storey | 84/313 |

*Primary Examiner*—Lawrence R. Franklin
*Attorney, Agent, or Firm*—King and Schickli

[57] ABSTRACT

A string locking assembly is provided for mounting on the headstock of a guitar or the like between a string nut and tuning pegs. The assembly includes a baseplate that is mounted directly to the headstock. The baseplate includes an outwardly disposed surface for supporting the guitar strings and outwardly extending posts at spaced intervals. The posts separate the individual strings and are sufficiently spaced to allow a wide range of string spacings to pass from the string nut to the tuning pegs through the assembly without interference. The assembly also includes a locking block overlying the strings and the baseplate and an associated cam action lock screw. The lock screw provides an unlocked position to allow quick tuning of the guitar and a locked position to provide clamping pressure between the locking block and the baseplate so as to prevent slippage of the strings over the string nut during play.

9 Claims, 3 Drawing Figures

STRING LOCKING ASSEMBLY FOR A MUSICAL INSTRUMENT

TECHNICAL FIELD

The present invention relates generally to musical instruments, and more particularly to a string locking assembly for selectively locking and maintaining the strings of a musical instrument, such as a guitar, against slippage during highly demanding playing conditions. The invention will be specifically disclosed in connection with a finger actuated locking assembly that may be easily retrofitted to a string instrument having a headstock, a string nut and tuning pegs, without the necessity of reconstructing the original string nut.

BACKGROUND OF THE INVENTION

Tremolo or vibrato devices for producing special effects on a guitar are well known in the prior art. In fact, various devices of this kind, having different structural configurations, are presently available in the marketplace. These devices allow a guitarist to provide a vibrato effect, that is, to alter the tone of the instrument by rapidly increasing or decreasing the string tension during play. This alteration in string tension is brought about by back and forth movement of the tremolo device by a hand lever that is capable of transmitting a substantial stretching force to the strings. This force, particularly under the most demanding playing conditions, leads to slight longitudinal slippage of the strings, and the subsequent failure of the guitar to return to the tuning which existed prior to the use of the tremolo device.

In the past, little attention has been paid to improving the string nut assembly for use with tremolo devices, either in terms of improving the holding ability or providing for quick release and readjustment. One device for securing the strings at the string nut location is disclosed in U.S. Pat. No. 4,171,661 to Rose. In this prior art patent, the conventional string nut is replaced by a special string nut assembly with a series of blocks held by single bolts or screws for clamping the strings of a guitar near the end of the guitar neck. Specifically, the Rose string nut assembly includes a series of rigid blocks, each block clamping a pair of strings on a U-shaped channel member by means of a single screw. The blocks overlie the strings and hold them in proper position within aligned V-shaped slots in outstanding edges of the U-shaped member when the screws are tightened; the strings being released for retuning the instrument when the screws are loosened.

The Rose nut assembly suffers from several serious drawbacks. In order to retune a guitar fitted with the Rose nut assembly, it is necessary to use a separate wrench or screwdriver to loosen the blocks and allow adjustment of the string tension. Such a time consuming and tedious operation is particularly inconvenient during a live performance. Additionally, the needed tools may not be available on stage or during a recording session when an audience and/or a highly paid sound technician is left sitting and waiting. Indeed, some guitar manufacturers have recognized this problem. However, they have attempted to solve it in a patchwork manner by attaching a tool holder to the back side of the peghead of the guitar. While the tool is then usually more convenient in such a holder, it is subject to be lost, or even fall out at the most inopportune times. Moreover, even when the tool is readily available, an inordinate amount of time is required to remove the tool, make the necessary adjustments, and return the tool to the holder.

Many of the above mentioned shortcomings of the prior art are overcome by the locking nut assembly disclosed in applicant's copending U.S. patent application Ser. No. 544,122, entitled Locking Nut Assembly For A Guitar. This last mentioned assembly includes a baseplate connected to a guitar neck near the peghead, which baseplate is also used in lieu of the more conventional string nut at the same location to separate and maintain the strings above the fretboard. The baseplate has an outstanding ridge with a series of spaced V-shaped slots for receiving individual strings of the instrument. A locking block is fitted on the baseplate to overlie the strings. When compressingly engaged by a cam action lock screw, the locking block applies a clamping pressure against the interposed strings, firmly and positively locking the strings against movement between the locking block and base plate.

The assembly disclosed in applicant's above identified copending patent application advantageously prevents string slippage on the guitar while the nut assembly is in a locked position. Hence, when a tremolo device is deactivated, the instrument returns to its original string tension and original tuning. Further, such an assembly is easily and rapidly moved, without tools, to an unlocked position to allow free movement of the strings for retuning the instrument. However, when it is desired to retrofit a conventional guitar, it is necessary to remove the original string nut to secure the locking nut assembly. The difficulties involved in removing an original string nut from a guitar have caused many guitarists to defer any such reconstruction to professional craftsmen or discouraged the use of tremolo devices altogether. Further, the V-shaped slots of both the prior art assemblies and applicant's above-described assembly accommodate only an extremely limited range of string spacings, and the V-shaped slots of such assemblies must be carefully coordinated and matched with the string spacings of a particular guitar.

Thus, even with the substantial improvements offered by the assembly of applicant's copending application, there is a strong need for a string locking assembly to retrofit existing string instruments without the necessity for reconstruction of the string nut. Further, there is a need for a more universal string locking assembly which is usable upon a variety of instruments having a wide range of string width spacings.

SUMMARY OF THE INVENTION

Accordingly, it is a primary object of the invention to provide a manually operable string locking assembly that may be retrofitted to an existing guitar or the like for selectively securing and releasing the instrument strings without the need of a tool and without the necessity of disassembling the original string nut.

Another object of the invention is to provide a universal manually operable locking assembly for selectively securing and releasing the strings of a musical instrument that is capable of accommodating a wide range of string spacings.

Still another object of the invention is to provide a manually operable retrofittable string locking assembly for a musical instrument that maintains the tune of a guitar after tremolo play.

A further object of the invention is to provide a string locking assembly for a musical instrument that may be easily retrofitted to an existing instrument without the need for a professional craftsman.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects and in accordance with the purposes of the present invention as described herein, an improved string locking assembly is provided for selectively locking the strings of a guitar or the like against slippage during highly demanding playing conditions. The locking assembly includes a baseplate adapted for secured mounting on the headstock of the instrument between a string nut and the tuning pegs. The baseplate includes an outwardly disposed surface for contacting and supporting the strings. A separating means configured to allow passage of a wide range of string spacings is mounted adjacent the support surface for separating the strings. Locking block means are adapted for mounting upon the support surface in overlying relationship to the strings. The locking block means selectively applies a clamping force against the strings to prevent string slippage. A cam action lock means selectively provides a pressure to urge the locking block means against the baseplate. The cam action lock means includes a cam having an unlocked position to allow quick tuning of the guitar and a locked position to provide clamping pressure against the strings interposed between the locking block and the baseplate. When in the locked position, the cam is operative to prevent slippage of the strings over the string nut under even highly demanding playing conditions.

The separating means preferably includes a plurality of spaced, outwardly extending posts. In a preferred arrangement, two parallel rows of outwardly extending posts are positioned to define a seating area for the locking block means on the contacting surface. The outwardly extending posts also prevent relative rotational movement between the locking block means and the baseplate to assure proper alignment of the locking block means.

In a more specific aspect of the invention, the cam action lock means includes a rotatable shaft passing freely through the locking block means and lockingly engaging the baseplate. A cam lever is mounted on an end of the shaft for cam action to apply the clamping pressure through the locking block means against the strings disposed between the locking block means and the baseplate.

The rotational shaft is preferably a screw threadably advanceable into the baseplate to allow rough adjustment of the clamping pressure.

In a further aspect of the invention, the screw includes a pivot pin extending transversely to the rotational axis of the screw. The pivot pin is operative to pivotally interconnect the screw to the cam lever, and the cam lever includes a pair of spaced cams for evenly distributing the cam force across the locking block means.

In a preferred form of the invention, the cam lever includes a wedge shaped tab operable by finger pressure, and the cam applies a substantially constantly increasing clamping pressure against the locking block means during movement of the cam to the locked position.

Still other objects of the present invention will become readily apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects, all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
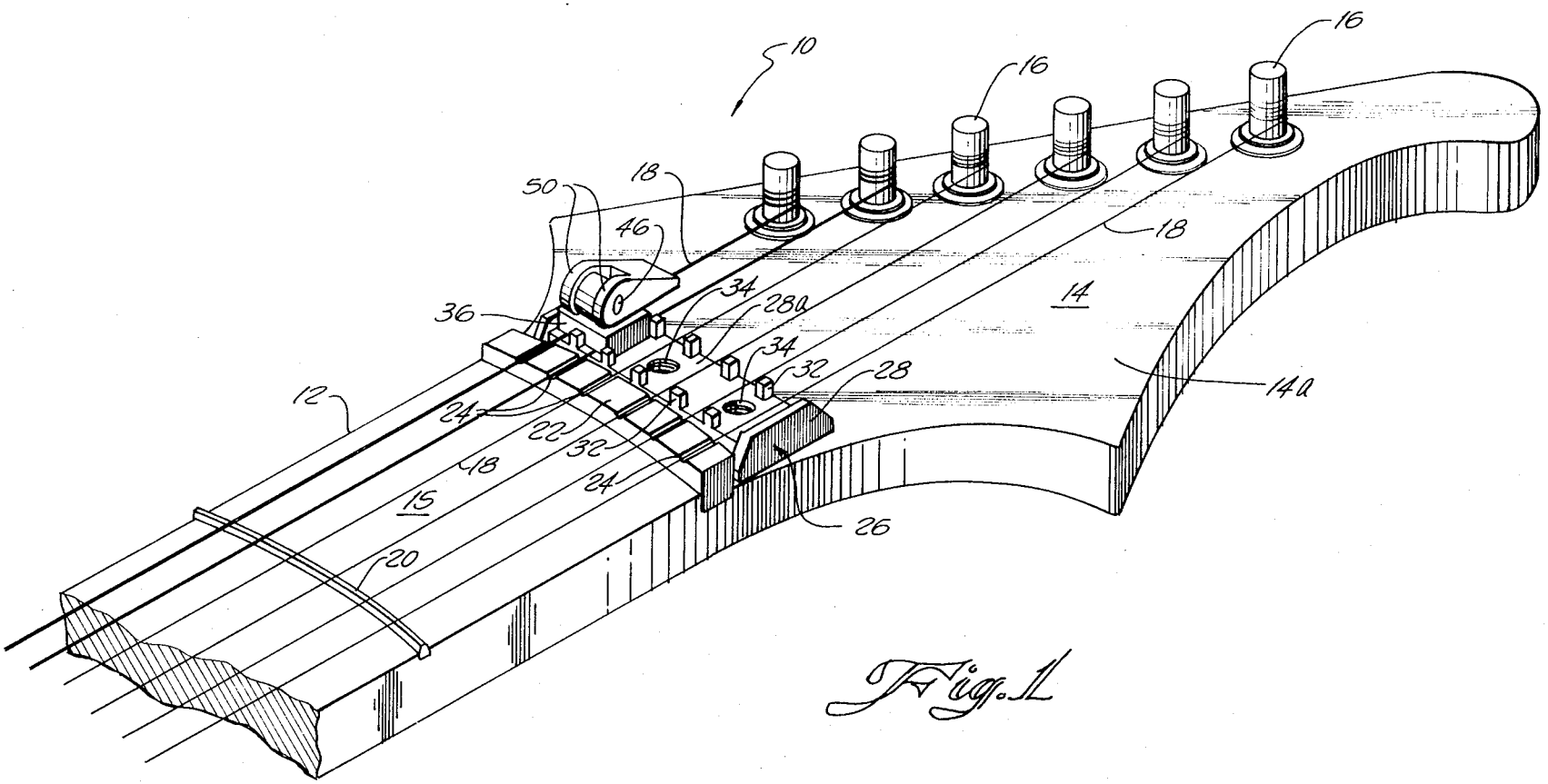
FIG. 1 is a fragmentary perspective view of the headstock of a guitar depicting a string locking assembly in accordance with the invention disposed between the string nut and the tuning pegs.

Reference is now made to FIG. 1 showing the outboard end of a guitar headstock generally designated by the numeral 10. The headstock 10 includes a neck 12 connected on one end to a peghead 14 and on the opposite end to a soundboard (not shown). The peghead portion 14 of the headstock 10 receives a series of spaced rotatable tuning pegs 16, which tuning pegs 16 extend completely through the peghead 14 protruding from both the front and rear peghead surfaces **14*a* and 14*b* respectively (the protrusion of the tuning pegs from rear peghead surface 14*b* is not illustrated in FIG. 1, see FIG. 2**).

A string 18 extends longitudinally from each of the tuning pegs 16 along a fretboard 15 formed on the front surface of the neck 12 to an appropriate string securement means on the soundboard (not shown) of the guitar. The strings 18 are maintained in laterally spaced relationship on the fretboard 15 above a plurality of longitudinally spaced and laterally extending frets 20 (only one of which is shown in FIG. 1). A string nut 22, positioned at the juncture of the fretboard 12 and peghead 14, also extends laterally across the headstock 10 in longitudinally spaced relationship to the frets 20. The string nut 22 has a plurality of longitudinally extending, laterally spaced notches 24, each of which receives an individual string 18 to laterally space and separate that individual string 18 from the remaining strings 18.

Figure 2:
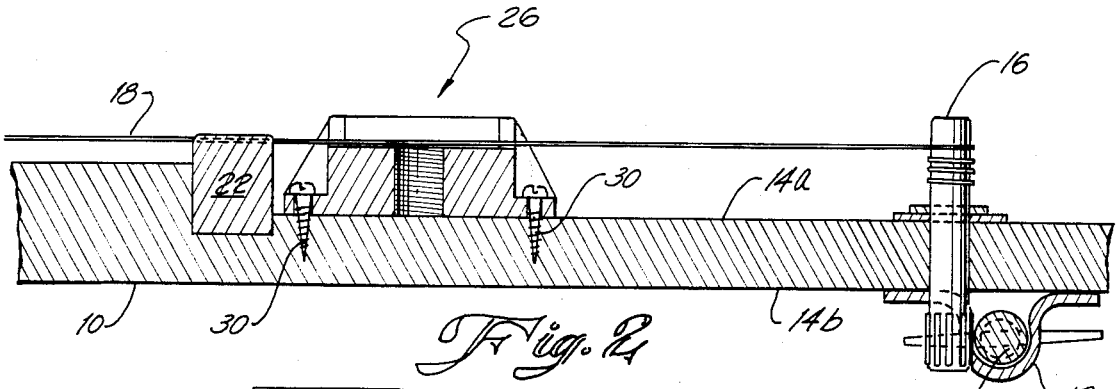
FIG. 2 is a fragmentary cross sectional view of the headstock and locking assembly of FIG. 1 taken longitudinally along the headstock.

As will be readily appreciated by those in the art, the tuning pegs 16 are rotated to increase or decrease the tension upon the strings 18 to achieve a desired tuning for the guitar. As shown in FIG. 2, rotation of each of the illustrated tuning pegs 16 is effectuated by manual rotation of a transversely extending coupling peg 17. Each of the coupling pegs (only one of which is illustrated in FIG. 2) are supported on the rear peghead surface 14*b* by a bracket 19 positioned to connect the individual coupling peg 17 to a corresponding tuning peg 16 through a suitable gearing arrangement.

Figure 3:
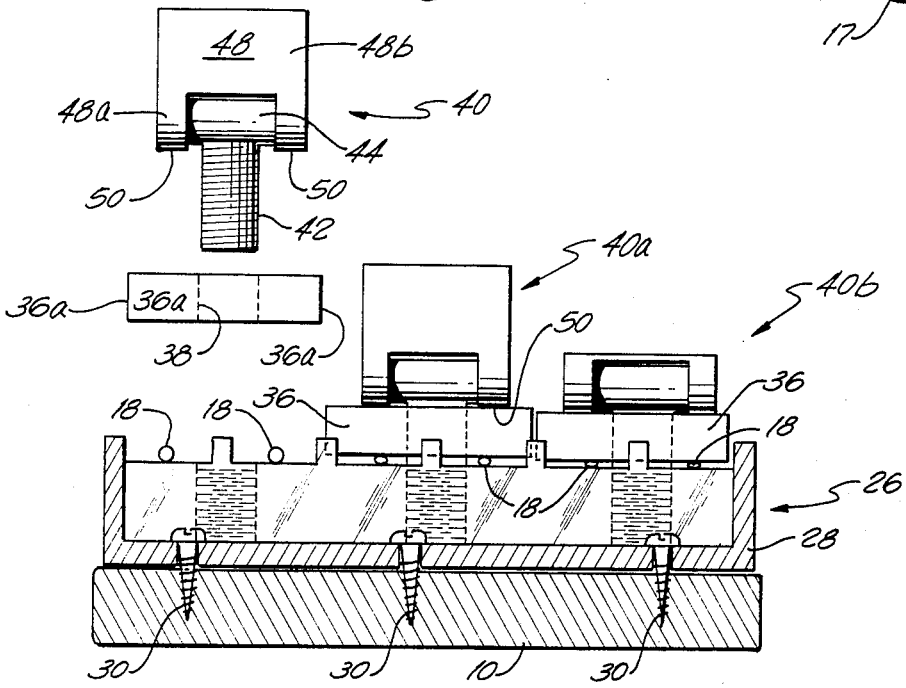
FIG. 3 is a partially exploded cross-sectional view of the locking assembly of FIGS. 1 and 2 and showing three cam lock screw assemblies in different positions.

In accordance with the broad aspects of the invention, a locking assembly 26 is mounted on the headstock 10 between the string nut 22 and the tuning pegs 16. The illustrated assembly 26 includes a base plate 28 mounted immediately adjacent the string nut 22. As illustrated in FIGS. 2 and 3, a plurality of screws 30 are used to secure the baseplate 28 to the headstock 10.

When mounted, the baseplate 28 has an outwardly disposed surface 28*a* for contacting and supporting the strings 18. Two parallel rows of laterally spaced outwardly extending posts 32 extend from the contacting surface 28*a* for separating the strings 18. As will be explained hereinafter, the outwardly extending posts 32 also define a locking block seat area on the contacting surface 28*a*. The baseplate 28 further includes a series of laterally spaced threaded apertures 34 opening to the contacting surface 28*a*.

A plurality of locking blocks 36 are further included in the locking assembly 26. These locking blocks 36 are adapted for seating on the contacting surface 28*a* in overlying relationship to the strings 18. Each of the locking blocks 36 has a centrally disposed aperture 38 which is brought into registry with a corresponding threaded aperture 34 in the baseplate 28. The diameter of each of the locking block apertures 38, however, is greater than the diameter of the the threaded apertures 34.

The locking blocks 36 are individually secured to the baseplate 28 by means of a cam action lock screw, generally designated by the numeral 40. Each of the cam action lock screws 40 includes a screw body 42 dimensioned to freely pass through the locking block aperture 38 and to be threadably received by the threaded apertures 34 in the baseplate 28.

As perhaps best realized by jointly viewing FIGS. 1 and 3, the locking blocks 36 of the preferred embodiment have a generally cuboidal configuration with each sidewall 36*a* being generally perpendicular to its adjacent sidewall. Preferably, the locking blocks are dimensioned such that, when seated on the contacting surface 28*a*, two of the locking block sidewalls 36*a* are positioned in close parallel relationship to opposite parallel rows of outwardly extending posts 32. With such an arrangement, the rows of outwardly extending posts 32 are operative to oppose any tendency of the lock screw 40 to rotate the locking blocks 36 with respect to the contacting surface 28*a*, and to assure and maintain proper alignment of the locking blocks 36 with the base plate 28.

Each of the cam action lock screws 40 also includes a head portion 44 extending generally perpendicularly to the rotational axis of the screw body 42. The head portion 44 has a passage (not shown) for receiving a pivot pin 46, which pin 46 also extends transversely to the rotational axis of the screw body 42 for pivotally connecting a cam lever 48.

The cam lever 48 is generally wedge shaped, as shown in FIG. 1, and includes a yoke portion 48*a* and a lever tab portion 48*b* adapted for actuation by finger pressure. The yoke portion 48*a* receives the interconnecting pivot pin 46. As best seen in FIG. 1, the yoke portion 48*a* has a pair of arcuate cam surfaces 50, each of which has a substantially constant radius. The cam surfaces 50 are equidistant from a point which is non-coincident with the rotational axis of pivot pin 46 so as to provide a camming action as the cam lever 48 is pivoted about the pivot pin 46. Specifically, this non-coincident point is located on an imaginary line normal to the surface of locking block 36 and passing through the axis of pivot pin 46 when the cam action lock screw 40 is in a fully unlocked position, such as shown by the cam lock screw 40*a* in FIG. 3. In this illustrated position of cam lock screw 40*a*, this non-coincident point is vertically above the axis of pivot pin 46. This shaping of the cam surfaces 50 substantially constantly increases the distance between the cam surfaces 50 and the pivot pin 46 in the direction normal to cam-locking block engagement area as the cam lock screw 40 is moved from an unlocked to a locked position. A fully locked position is depicted by cam lock screw 40*b* in the same FIG. 3 illustration.

Advantageously, the locking assembly 26 is easily and readily retrofitted to an existing guitar without the need for reconstruction. The baseplate 28 is positioned and secured alongside the string nut 22 on the outer headstock surface 14*a*, between the string nut 22 and the tuning pegs 16. When so positioned, the strings 18 are directed over and supported by the contacting surface 28*a*, between the outwardly extending posts 32. The outwardly extending posts 32 have substantially large lateral spacings so as to permit passage of a relatively wide range of spacings for the strings 18. For example, in one preferred form of the invention, the outwardly extending posts 32 are laterally separated by a space in the order of 1 cm.

As suggested by the partially exploded depiction of FIG. 3, the screw body 42 of the cam action lock screw 40 is fed through the locking block aperture 38 into the threaded baseplate aperture 34. The cam lever portion 48 of the cam action lock screw 40 is then used to rotate the screw body 42 to bring the arcuate cams 50 into engagement with the locking block 36, thereby securing the locking block in engagement with the interposed strings 18 positioned between the locking lock 36 and the baseplate 28. It should be appreciated that the cam lever portion 48 of the cam action lock screw 40 allows this operation to be performed by hand without the need of additional tools.

When the lever tab 48*b* is in the upright, unlocked position as shown by cam lock screw 40*a* in FIG. 3, relatively little pressure is applied against the strings 18, thereby allowing easily longitudinal movement of the strings 18 for the purpose of tuning the guitar through rotation of the tuning pegs 16. However, when the cam lever portion 48 is flipped down into the locked position as shown by cam lock screw 40*b* in FIG. 3, the clamping pressure on strings 18 between the locking block 36 and the baseplate 20*a* is substantially increased by the action of cams 50. Therefore, when the cam lever 48 is locked, the strings are firmly and positively held in place so as to prevent slipping or longitudinal movement. Even the demanding tensile stresses applied to the strings 18 during extended tremolo play will not cause slippage of the strings 18 when the cam levers 48 are locked in this manner. Consequently, the guitar will maintain its pretremolo tune after tremolo play.

Further, when the cam lever 48 is in the upright, unlocked position, the screw body 42 may be rotated by hand (by grasping lever portion 48*b*) to roughly increase or decrease the cam force when the lever portion 48 is once again moved to the locked position. The rough adjustment provided by this easy manipulation of the cam action lock screw assures a suitable range of proper functioning of the locking assembly 26 regardless of the thickness of the strings 18. Fine adjustment of the clamping force for the assembly is provided by depressing the lever portion 48*b* with more or less pressure when final locking takes place.

Should retuning of the guitar become necessary, the cam lever 48 may be finger actuated for movement to the unlocked position shown by cam action lock screw 40*a* in FIG. 3. Again, in this position, the clamping pressure on the strings 18 is released and longitudinal movement of the strings over the string nut 22 is permitted. Thus, it should be appreciated that the locking assembly 26 of the present invention allows rapid and easy retuning of the guitar without the need of a wrench, screwdriver or other tool. Following retuning, the locking of the cam lever portion 48 once again provide clamping pressure to the strings 18 sufficient to maintain the new tuning of the guitar.

The clamping efficiency of the cam action lock screw 40 against the block 36 is maximized by the unique design of the lock screw. The two spaced apart cams 50 of the yoke portion 48*a* are effective to contact the illustrated locking block 36 substantially adjacent the edges. This is true regardless of the relative rotational position of the cam action lock screw with respect to the locking block 36. As will be apparent, the clamp force is thus more evenly distributed, providing more effective locking of the strings 18 in position.

Also, since the spaced cam construction provides a substantially straight down clamping, the locking block 24 does not tend to skew or rotate during tightening. The outwardly extending posts 32 also function to positively prevent any such rotation. Rotation of the locking blocks 36 relative to the baseplate 28 would introduce false tightening action and potential slippage of the strings.

In summary, numerous benefits have been described which result from employing the concepts of the invention. The locking assembly of the invention may be easily retrofitted to an existing guitar without modification of the existing string nut assembly and without the need for a highly skilled craftsman. The assembly cooperates with a conventional string nut and accommodates a wide range of string spacings. No wrenches, screwdrivers or other tools are needed to lock or unlock the strings, and locking and unlocking may be very rapidly and easily achieved. The cam action of the locking screw is operable by finger pressure to provide sufficient clamping force to the strings to prevent string slippage and to maintain the tuning of the guitar, even after the demanding conditions of tremolo play. Easy adjustment of the clamping pressure on the strings is provided by tightening or loosening the cam action lock screw for rough adjustment and depressing the lever tab with the desired pressure for fine adjustment. Hence, the desired pressure may be readily regulated by the sensitive feel of a musician. The finger actuation of the lever tabs to the unlocked position allows quick release for retuning of the instrument without the need of additional tools.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best description of the principles of the invention and its practical application to thereby enable one of ordinary skill in the art to utilize the invention in various embodiments and with various modifications as are suited to the particular use contemplated. All such modifications and variations are within the scope of the invention as defined by the appended claims when interpreted with the breadth to which they are fairly, legally, and equitably entitled.

I claim:

1. A string locking assembly for use on a musical instrument including a headstock, a string nut, tuning pegs supported upon said headstock, and a plurality of strings extending between the string nut and the tuning pegs, comprising:

(a) a baseplate adapted for secured mounting to the headstock of the instrument between the string nut and the tuning pegs, said baseplate including an outwardly disposed surface for contacting and supporting the strings;

(b) means mounted adjacent the string contact surface of said baseplate for separating the strings, said separating means being configured to allow passage of a wide range of string spacings through the assembly, from the string nut to the tuning pegs, without causing string stretching and detuning;

(c) a plurality of locking block means adapted to mount upon the support surface of the baseplate in overlying relationship to the strings for selectively applying a clamping force to the strings interposed between the baseplate and the locking block means, two opposite sidewalls of each of said locking block means extending substantially perpendicular to said strings and substantially in engagement with said string separating means so as to prevent rotation of said locking block means relative to said baseplate during clamping;

(d) cam action lock means for selectively providing pressure to urge said locking block means against said baseplate, said cam action lock means including a cam lever having an unlocked position to allow quick tuning of the guitar and a locked position to provide clamping pressure against the strings interposed between said locking block and said baseplate so as to prevent slippage of the strings over the string nut during play; and (e) means for selectively adjusting the distance between said baseplate and said lock means in said locked position to permit the clamping force to be adjustably controlled when clamping strings of different diameters.

2. An assembly as recited in claim 1, wherein said separating means includes a plurality of spaced, outwardly extending posts.

3. An assembly as recited in claim 2 wherein at least one of said posts cooperates with said locking block means to prevent relative rotational movement between the locking block means and the baseplate to assure proper alignment of the locking block means.

4. A string locking assembly for use on a musical instrument including a headstock, a string nut, tuning pegs supported upon said headstock, and a plurality of strings extending between the string nut and the tuning pegs comprising:

(a) a baseplate adapted for secured mounting to the headstock of the instrument between the string nut and the tuning pegs, said baseplate including an outwardly disposed surface for contacting and supporting the strings;

(b) means mounted adjacent the string contact surface of said baseplate for separating the strings, said separating means being configured to allow passage of a wide range of string spacings through the assembly, from the string nut to the tuning pegs, without causing string stretching and detuning;

(c) locking block means adapted to mount upon the support surface of the baseplate in overlying relationship to the strings for selectively applying a clamping force to the strings interposed between the baseplate and the locking block means; and (d) cam action lock means for selectively providing pressure to urge said locking block means against said baseplate, said cam action lock means including a height adjustable, rotatable shaft passing freely through said locking block means and lockingly engaging said baseplate, and a cam lever mounted on an end of said shaft for cam action; said cam lever having an unlocked position to allow quick tuning of the guitar and a locked position to provide clamping pressure against the strings interposed between said locking block and said baseplate so as to prevent slippage of the strings over the string nut during play.

5. An assembly as recited in claim 4, wherein said rotatable shaft is a screw, and said screw is threadably advanceable into said baseplate to allow rough adjustment of the clamping pressure.

6. An assembly as recited in claim 5, wherein said screw includes a pivot pin extending transversely to the rotational axis of the screw, said cam lever being pivotally interconnected to said screw through said pivot pin and said cam lever defines spaced cams for evenly distributing the cam force across said locking block means.

7. An assembly as recited in claim 6, wherein the cam lever includes a pair of spaced cam surfaces for evenly distributing the clamping pressure across said locking block means.

8. An assembly as recited in claim 7 wherein said cam lever includes a wedge shaped tab operable by finger pressure, and the cam surfaces are equidistant from a point non-coincident with the rotational axis of the pivot pin and positioned to substantially constantly increase the distance between the cam surface and the pivot pin axis in the direction normal to the cam-locking block means engagement area during movement of the cam to the locked position.

9. A string locking assembly for use on a musical instrument including a headstock, a string nut, tuning pegs supported upon said headstock, and a plurality of strings extending between the string nut and the tuning pegs, comprising:

(a) a baseplate adapted for secured mounting to the headstock of the instrument between the string nut and the tuning pegs, said baseplate including an outwardly disposed surface adjacent the strings;

(b) a plurality of locking block means adapted to mount upon the surface of the baseplate adjacent the strings for selectively applying a clamping force to the strings;

(c) means mounted adjacent the surface of the baseplate for separating the strings and preventing said locking blocks from rotating during clamping, said separating means being positioned substantially in engagement with two opposite sidewalls of each of said locking block means extending substantially perpendicular to said strings and being configured to allow passage of a wide range of string spacing through the assembly from the string nut to the tuning pegs without causing string stretching and detuning;

(d) cam action lock means for selectively providing pressure to urge said locking block means against said strings, said cam action lock means including a cam lever having an unlocked position to allow quick tuning of the guitar and a locked position to provide clamping pressure against the strings so as to prevent slippage of the strings over the string nut during play; and (e) means for selectively adjusting the distance between said baseplate and said lock means in said locked position to permit the clamping force to be adjustably controlled when clamping strings of different diameters.

* * * * *